United States Patent [19]

Vermot-Gaud et al.

[11] Patent Number: 4,875,347

[45] Date of Patent: Oct. 24, 1989

[54] METHOD OF ACTUATION OF NEEDLE SELECTION LATCHES OF A KNITTING MACHINE, AND A DEVICE FOR PERFORMING THE METHOD

[75] Inventors: Jacque Vermot-Gaud, Perly, Switzerland; Rémi Cottenceau, Viry, France; Erwin Zuercher, Le Lignon, Switzerland

[73] Assignee: Sipra Patententwicklungs-und Beteiligungsgesellschaft mbH, Albstadt, Fed. Rep. of Germany

[21] Appl. No.: 278,339

[22] Filed: Dec. 1, 1988

[30] Foreign Application Priority Data

Dec. 4, 1987 [CH] Switzerland ..... 4745/87

[51] Int. Cl.[4] ..... D04B 9/10

[52] U.S. Cl. ..... 66/219; 66/75.2

[58] Field of Search ..... 66/219, 218, 221, 232, 66/75.2

[56] References Cited

U.S. PATENT DOCUMENTS 3,812,691 5/1974 Engelfrieo ..... 66/219
3,948,062 4/1976 Sumitomo ..... 66/220
4,023,383 5/1972 Klinger ..... 66/220
4,481,793 11/1984 Cuche et al. ..... 66/75.2

FOREIGN PATENT DOCUMENTS 2409415 8/1974 Fed. Rep. of Germany ..... 66/219
2424190 12/1975 Fed. Rep. of Germany ..... 60/219

*Primary Examiner*—Ronald Feldbaum
*Attorney, Agent, or Firm*—Cushman, Darby & Cushman

[57] ABSTRACT

In a knitting machine, a selection latch having two end positions for selecting a knitting-needle is actuated so as to engage a cam which moves the selected latch towards a second end position. The actuation of the selection latch in two stages reduces the displacement brought about by the actuating means and increases the selection frequency. According to the invention the latch is actuated by a thin needle similar to a needle-printer needle, producing an impact on the latch, resulting in transmission of motion with high efficiency and moving the latch into an intermediate position in which the cam brings the latch into its second end position. This substantially eliminates friction between the actuating means and the latch, and enhances the selection frequency.

14 Claims, 2 Drawing Sheets

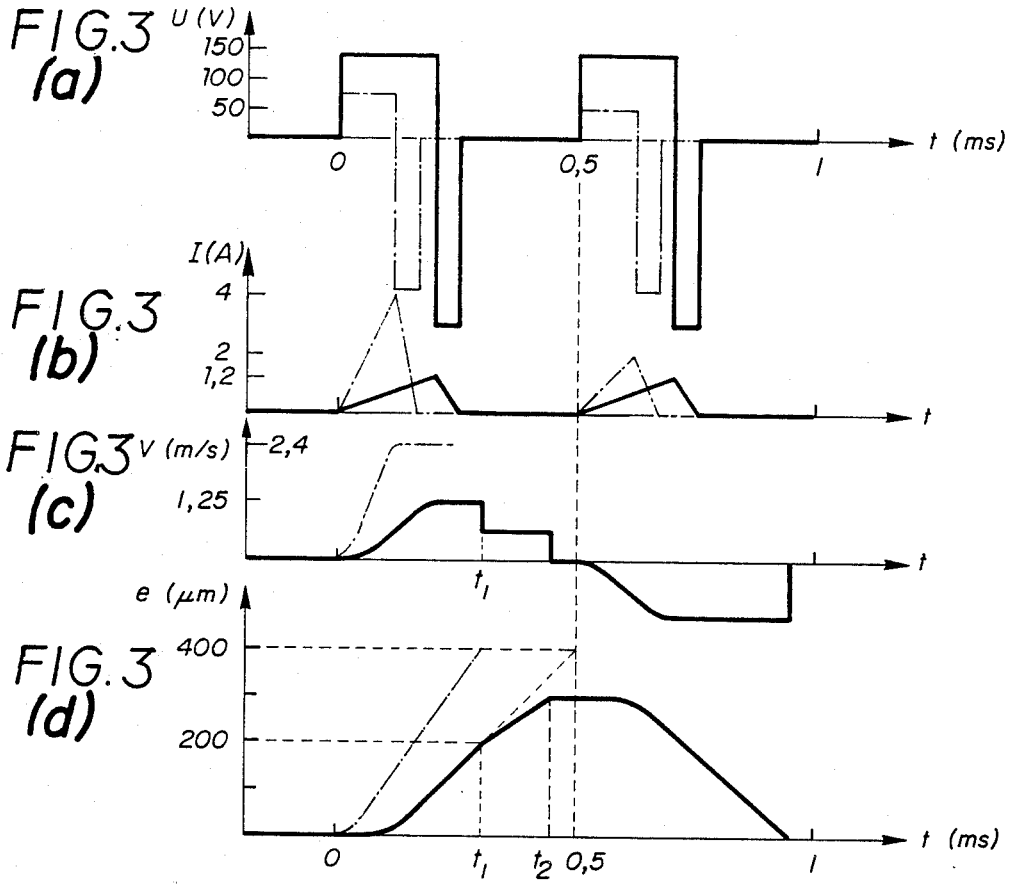
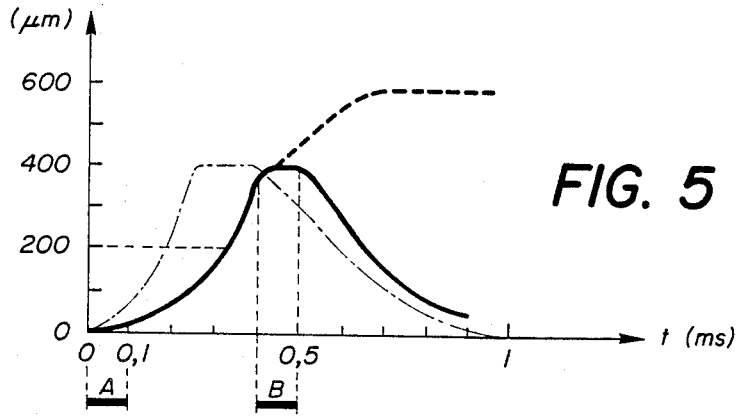
FIG. 5

METHOD OF ACTUATION OF NEEDLE SELECTION LATCHES OF A KNITTING MACHINE, AND A DEVICE FOR PERFORMING THE METHOD

BACKGROUND OF THE INVENTION

The invention relates to a method of actuating the needle selection latches of a knitting machine, the latches being adapted to occupy two end positions, the transition from the first to the second end position being in made in two stages, a first stage consisting in bringing a component of the latch into engagement with a cam and a second stage resulting from the displacement of the cam relative to the latch transversely to the plane in which the latch oscillates. The invention also relates to a device for performing the method.

In order to increase the selection rate of knitting machines, it has become necessary to increase the number of selection levels, for reasons both of bulk and of limitations to the actuating frequency, which is usually at a maximum of about 150 Hz. The number of selection levels is increased by adversely altering the bulk, by increasing the number of electromagnets and consequently increasing the price. In any case the number of levels is limited and the maximum total of selection frequencies is 600–800 Hz over all the levels.

DISCUSSION OF THE PRIOR ART

CH-476 880 has already proposed a selection mechanism in which all the selection means are brought to a given first position at the beginning of each knitting-machine feed and, in this position, enter the air gap of an electromagnet where the selection means are retracted by one pole thereof. A ramp formed by a permanent magnet follows each pole of the electromagnet, so that the selection means attracted by one pole follows the ramp, which moves the selection means into a second position in a direction in a plane perpendicular to the path of the selection means relative to the magnetic ramps. When it has been brought to the second position, the selection means acts or does not act on a jack for selectively engaging a needle with a knitting cam, depending on which pole of the electromagnet has attracted the selection means.

The electromagnetic selection means displaces the selection means only very slightly, the rest of the movement being brought about by the magnetic ramps. Owing to the smallness of the displacement brought about by the electromagnetic selection mechanism, the selection frequency can be substantially increased, depending on the amplitude of the required movement.

However, this method has various disadvantages. Since the selection means must be of mild steel having low magnetic remanence, the selection can be made only on a distinct component of the needle, intended only for moving the butt of the needle, which must be made of spring steel. Another disadvantage of this method is that only two positions can be controlled, since when the selection means enters the air gap of the electro-magnet adjacent the two magnetic ramps, it must be attracted by one of the two poles. It cannot be left in an intermediate non-guided position, since it would still be likely to be attracted by one of the magnetic ramps which, at their ends adjacent the electromagnet, are very close to the selection means. If the selection means is not then guided and is very slightly off-centre, there is a good chance that it will be brought against the nearer ramp, resulting in faulty selection. In this method, therefore, the third position is manually controlled and therefore cannot be modified during knitting. Another disadvantage of this method is that the selection means is moved by attraction as it moves along the magnetic ramps. If abnormal resistance occurs during the movement of the selection means, it may come away from the magnetic ramp.

It has also been proposed in DE-A-1804350 to actuate the butts of the selection jacks by using a mechanism driven by an actuating means made of a material which undergoes dimensional deformations when acted upon by an electric current or a magnetic field, thus avoiding the magnetic remanence, which results in sticking between fixed and moving parts. Sticking occurs during direct contact between the fixed and moving cores of an electromagnetic circuit. As this document clearly shows, however, the movement of the jack butt out of engagement with the alignment cam is directly dependent on the amplitude of deformation of the actuating means, which excludes any movement following an elastic impact. According to the theory of the dynamics of impacts, transmission of motion by elastic impact requires that after an infinitely short time of contact between the striking and the struck members the speeds of these members must undergo a finite variation. Transmission of motion by elastic impact between two members is said to occur when the coefficient of restitution between the velocity components of each of these members at the beginning and the end of the impact is near unity. The striking member must therefore instantaneously lose all or most of its speed to the struck members, as between two billiard balls. Clearly under these conditions, the displacement of the struck members can in no case depend on the amplitude of the striking members as in DE-A-1804350. Also, this document makes no use of a two-stage displacement, in which the actuating means produces only part of the motion of the selected means, the motion being subsequently amplified by a cam profile in association with the motion of the needle bed relative to the cam support for actuating the knitting machine.

The object of the invention is at least partly to obviate the aforementioned disadvantages.

SUMMARY OF THE INVENTION

According to the present invention, the needle selection latch is moved by the application of an elastic impact or collision.

Specifically this invention provides a method of actuating needle selection latches in a knitting machine, said latches being movable between two end positions, comprising the steps of: applying an elastic impact to a surface of a latch to be selected thereby moving said latch from a said end position into engagement with a cam, and effecting relative movement of said cam and latch thereby moving said latch into the other said end positions.

Further this invention provides in a knitting machine comprising a plurality of knitting needles, a plurality of selection latches for selecting said needles respectively, each said latch being mounted for movement between first and second end positions, a selection means adapted to select individual latches, a cam, and means for effecting relative movement of said cam and said latches transversely to a plane in which said latches move, said selection means being arranged and adapted to move a selected latch from said first end position to an intermediate position in engagement with said cam, said relative movement of said cam and the selected latch effecting further movement of said latch into its said second end position; the improvement wherein the selection means comprises a striker movable towards and away from the latch to be selected, and striker drive means operative to advance the striker towards and into contact with the latch such as to apply an elastic impact to said latch for moving it to said intermediate position, and to retract said striker.

The advantages of the present method are numerous in the case of a high-frequency needle selection device. As will be seen hereinafter, it can be used for selection at a frequency of at least 1000 Hz at a single level. The effect of striking is to eliminate friction between the actuating and the actuated means. Since the transmission of energy between these two means is practically instantaneous, the travel of the actuating means can be very short. Once the impact energy has been communicated to the actuated means, it moves until the energy has disappeared, so that the actuating means can be returned during the movement of the actuated means. The energy efficiency of this transmission of motion is excellent. The actuating means can be similar to a needle-printer needle, so that the actuating motor can be moved towards the exterior and thus increase the available space in the case of a circular knitting machine, the motor extending radially away from the needle bed, and the volume and power of the motor can be increased.

BRIEF DESCRIPTION OF THE DRAWINGS

These various advantages together with others will appear from the following description and accompanying drawings, which very diagrammatically and by way of example illustrate a form of the method and an embodiment of the device for performing the method. In the drawings:

FIGS. 3*a–d* are graphs showing the theoretical appearance of a selection movement;

FIG. 5 is a graph showing the nature of the motion of the actuating means relative to the actuated means.

DESCRIPTION OF PREFERRED EMBODIMENTS

The aim is to select the needles of the cylinder and plate of a knitting machine 76.2 cm (30″) in diameter comprising 72 gauge 28 knitting systems and having a circumferential speed of 1 m/s with the possibility of selecting three simultaneous modes, i.e. stitch, tucking and zero. Apart from problems of bulk when selecting the knitting-machine needles, feasibility depends mainly on the possibility of selecting the latches with practically complete reliability. In this description, therefore, we shall not dwell on problems other than those of actuation of latches pivotably mounted in recesses in the needle body and constituting a known type of selection means. We shall only discuss the possibility of actuating the latches allowing for the aforementioned parameters.

As is known, the selection means is pivoted in two stages, the first consisting in a short movement in which the latch engages a cam. This first stage is specifically the subject of the invention.

Figure 1:
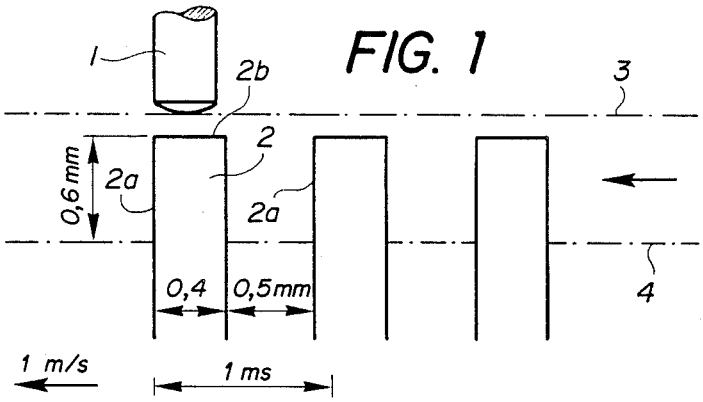
FIG. 1 is a diagram illustrating the position of the problem to be solved.

FIG. 1 illustrates the various parameters involved in pre-selecting the latches. The drawing shows a needle 1 for actuating latches 2. The actuating needle 1 is adapted to move longitudinally with respect to its axis. When at rest, it occupies the position shown, the front end of needle 1 corresponding to the return line 3. The return line 4 represents the position to be reached by latches 2 after preselection.

In the theoretical calculations hereinafter, the following values are assumed:

The pitch between two sides 2*a* of two successive latches 2, gauge 28, is 0.9 mm, made up of 0.4 mm thickness of the latch and 0.5 mm spacing between latches. When the needle bed moves at 1 m/s, therefore, the time between passing two sides 2*a* of two successive latches is 0.9 mm. The distance between the end face 2*b* of latch 2 and the return line 4 is 0.6 mm. The mass of a latch is 0.2 g which, allowing for the moment of inertia, corresponds to an equivalent mass of 0.1 g.

A complete analysis of the various possible modes of actuation of latches 2, allowing for the aforementioned parameters, show that there are two main problems, both when the latch is actuated by thrust only and when the actuating needle acts by lateral abutment against an inclined surface of the latch. The problems are friction in both cases and lack of reliable actuation by thrust only. An analysis has also been made of actuation when the two surfaces in contact are inclined and parallel, resulting in actuation partly through movement of the actuating needle and partly via the peripheral speed of the latch driven by the needle bed. However, the disadvantage of this method is that the conditions for actuating the latch are varied when the knitting-machine starts, so that actuation of the latches is not guaranteed at this stage.

This is the reason why it has been found that the solution enabling the conditions of reliability and absence of friction to be combined, is for the latch to be pushed exclusively by impact, as will be explained.

The principle of transmission of motion by impact is as follows:

| | | |
|---|---|---|
| before the impact | $V_1$ | $V_2$ |
| | $M_1$ | $M_2$ |
| after the impact | $V'_1$ | $V'_2$ |
| | $M_1$ | $M_2$ |

The impact follows the following two laws, i.e. the law of conservation of momentum:

$$M_1 V_1 + M_2 V_2 = M_1 V'_1 + M_2 V'_2 \text{ and}$$

the law of the ratio $R$ of restitution of velocity:

$$(V'_2 - V'_1) = -R\,(V_2 - V_1)$$

If $R=1$ and $V_2=0$, these relations become:

$$M_1 V_1 = M_1 V'_1 + M_2 V'_2$$

$$V'_2 - V'_1 = V_1$$

Consequently:

-continued $$V'_1 = V_1 \frac{M_1 - M_2}{M_1 + M_2} \text{ and } V'_2 = V_1 \frac{2M_1}{M_1 + M_2}$$

We shall now take an example in which $$M_1 = 0.4 \text{ g } V_1 = 1 \text{ m/s } M_2 = 0.1 \text{ g}$$

$$\phi = (U/N)\, t$$

$$B = (U/NS)\, t$$

We shall now examine the situation with regard to the constraints during the impact. To this end we shall use the method of Hertz according to Peter A. Engel, "Impact Wear of Materials", page 47, Elsevier 1976. At the moment of impact, materials are subjected to compression resulting in an impulse of force F(t) which modifies the momentum of the two masses present as per the expressions $V'_1$ and $V'_2$ and acts on the masses $M_1$, $M_2$ in accordance with the relation $$M_1 d^2x_1/dt^2 = -M_2 d^2x_2/dt^2 = -F(t)$$

The impulse of force F(t) is related to the elastic crushing $\Delta x = x_1 - x_2$, the shape of the bodies in contact and the nature of the materials (Young's Modulus and Poisson's, coefficient). Under quasi-static conditions, Hertz's theory can be used to determine the force in dependence on the elastic crushing. In the case of two steel spheres having the same radius R, a Young's modulus of $2.10^{11}$ N/m$^2$ and a Poisson's coefficient of 0.3:

$$F = n(\Delta x)^{3/2}$$

with $n = 1.03 \times 10^{11} R$.

The differential equation relating the elastic crushing to the relative acceleration of the two masses $M_1$ and $M_2$ is then:

$$(1/n_1) d^2(\Delta x)/dt^2 + F = 0$$

with $n_1 = (M_1 + M_2)/M_1 M_2$, and the initial conditions are:

$$\Delta x = 0 \text{ and } d(\Delta x)/dt = V_1 - V_2$$

The solution of this equation gives the maximum amplitude and the duration of elastic crushing:

$$(\Delta x)_{max} = [1{,}25(V_1 - V_2)^2/nn_1]^{2/5}$$

$$T = 2.9(\Delta x)_{max}/(V_1 - V_2)$$

The maximum force $F_{max}$, the maximum radius $r_{max}$ of the surface area of contact and the corresponding pressure $P_{max}$ are then:

$$F_{max} = n(\Delta x_{max})^{3/2}$$

$$r_{max} = (\Delta x_{max})R/2$$

$$P_{max} = 1.5 F_{max}/\pi r^2_{max}$$

We shall now examine a worked example in which:

$$R = 2 \times 10^{-3} \text{ m}, V_1 = 2 \text{ m/s}$$

$$M_1 = 0.4 \text{ g}, M_2 = 0.1 \text{ g}$$

We obtain:

$(\Delta x)_{max} = 6\ \mu m$ $T = 8.6\ \mu s$ $F_{max} = 67N$ $r_{max} = 80\ \mu m$ $P_{max} = 5000$ MPa This example shows that the method of actuation according to the invention, in which the latch 2 is pushed by impact, fulfils the required conditions at the mechanical interface. The initial speed communicated to the latch can be greater than 1 m/s whereas the required speed is 0.6 m/s. The maximum pressure of 5000 MPa, with a radius of curvature of the surface areas in contact of 2 mm, is acceptable. The pressure can also be reduced by increasing the radius of curvature. The time in contact is of the order of 10 μs. Since the needle bed carrying the knitting needles in which latches 2 are pivoted moves at a speed of 1 m/s, the movement of the actuating needle 1 relative to the latch 2 for selection is therefore 10 μm during the impact, and this can easily be absorbed by the elasticity of the actuating needle 1 and the clearance between the latch and its guide groove. Consequently this method of actuation by impact avoids any friction between the actuating needle 1 and the latch 2, thus considerably reducing wear and consequently reducing the maintenance work on the knitting machine.

Owing to the very slight penetration of the actuating needle into the path of the latch butts **2*b*, it is relatively easy to prevent damage to the system if a needle 2** is not withdrawn sufficiently quickly from the next latch.

Since transmission of movement by impact requires a certain inertia and therefore a certain mass of the striking member, i.e. of the actuating needle, we must examine the conditions to be satisfied by the needle-driving mechanism.

Allowing for the aforementioned specification on the knitting machine, the space available for the drive mechanism is 25 mm, the mass of the needle is between 0.1 and 0.5 g and its motion allowing for the required safety margins needs to be 0.4 to 0.6 mm, the penetration into the latch trajectory being 0.2 to 0.3 mm. The speed to be reached at the moment of impact is 1 m/s. The time available for reaching this speed is 0.2 to 0.4 m/s, and consequently the required acceleration is 2500 to 5000 m/s$^2$. The return movement needs to be similar if the outward and return travel of the needle is to last less than 1 ms.

Figure 2:
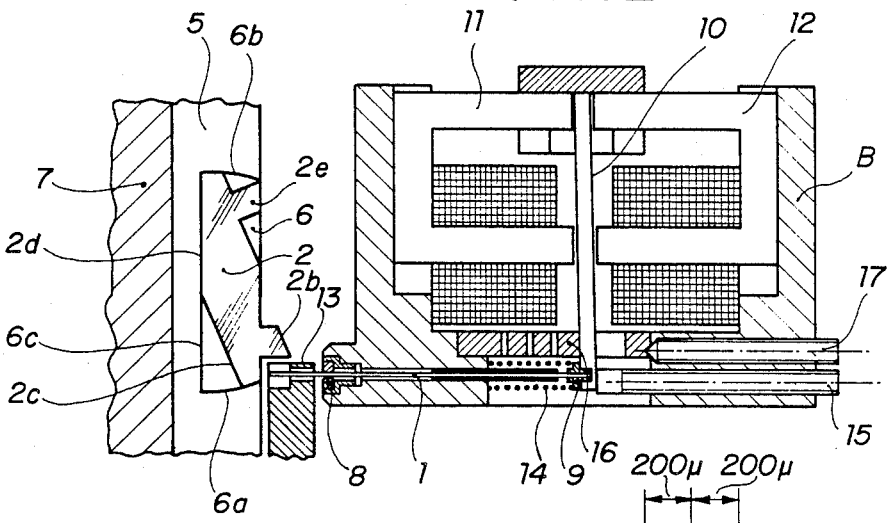
FIG. 2 is a view in partial diametral section or cross-section of this embodiment of the device, depending on whether the knitting machine is circular or flat.
Figure 6:
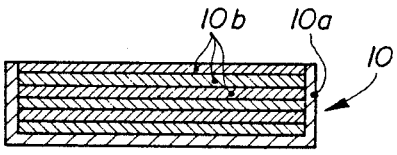
FIG. 6 is a very large-scale view in section of a detail of FIG. 2

In view of these specifications, in this example we chose a double-acting electromagnetic drive mechanism as shown in FIG. 2. A knitting needle 5, shown very partially, is disposed in a division of a needle bed 7. A selection latch 2 is mounted for oscillation in a recess 6 in the knitting needle 5. The edges **6*a*–6*b* of recess 6 form an arc of a circle and cause the butts 2*b*, 2*e* of latch 2 to move in a circular trajectory between its two end positions defined by its edges 2*c*, 2*d* on the one hand and by the space 6*c* of recess 6 on the other hand. A cam 13 is disposed facing the needle bed 7. With respect to the plane perpendicular to FIG. 2, the cam is either fixed or movable depending on the type of circular machine or is movable in the case of a flat machine and is adapted to engage the butt 2*b* of latch 2 when latch 2 is moved by needle 1 into its second end position. Needle 1 is longitudinally guided by a sapphire sliding bearing 8 mounted in a frame B carrying the electromagnetic mechanism and secured to cam 13. The rear end of needle 1 is secured to a bush 9 engaging a plate 10 mounted for oscillation in the air gap of two electromagnets 11 and 12. A coil return spring 14 coaxial with needle 1 bears at one end on a surface of frame B and at the other end on bush 9, thus tending to press bush 9 against plate 10. An adjustment abutment 15 comprising a screw limits the return of plate 10 and prevents it touching the fixed core of electromagnet 12, thus preventing sticking and remanence. A second adjustable abutment 16 comprises an elastic component associated with an adjusting screw 17 which, by pressure, can deform the elastic component to a varying extent and thus adjust the position of the abutment and prevent the plate from touching the fixed core of electromagnet 11. If the current fails, the return spring 14 can move needle 1** out of the path of the latches.

The problem posed by this kind of drive mechanism in high-frequency applications is due to the delay resulting from the inductance of the winding. When the supply voltage is applied to it, the current does not appear instantaneously but is dependent on time in accordance with the following relation (in the case of a constant voltage):

$$i=(U/L)t$$

where i is the current, U is the voltage, L is the inductance$=\phi N/i$, t=time, N is the number of turns, $\phi$ is the magnetic flux=BS, B is the magnetic induction and S is the cross-section of the magnetic circuit.

The flux and the magnetic induction can be expressed in dependence on the applied voltage:

$$\phi=(U/N)t$$

$$B=(U/NS)t$$

The induction increases in proportion with time until saturation of the ferromagnetic material, which is reached at an induction of $B_s$ after a time T:

$$B_s=(U/NS)T$$

The force exerted on the moving plate at the two air gaps is:

$$F=B^2S/\mu_o$$

where $\mu_o$ is the permeability of a vacuum.

In dependence on time, this force is:

$$F=\frac{B_s^2}{T^2}\ \frac{S}{\mu_o}\ t^2$$

As can be seen the force is a function of $t^2$, which introduces a true delay before the speed v is reached. If we consider the acceleration F/m, where m is the mass of plate 10, we have:

$$dv/dt=F/m=(B_s^2S/T^2\mu_o m)t^2$$

$$v=(B_s^2S/T^2\mu_o m)(t^3/3)$$

The displacement e is obtained by integrating $$de/dt=v$$

$$e=(B_s^2S/T^2\mu_o m)(t^4/12)$$

The force reaches its maximum for t=T.

The corresponding speed and displacement are:

$$v(T)=(B_s^2S/3\mu_o m)T$$

$$e(T)=(B_s^2S/3\mu_o m)(T^2/4)$$

The mass m depends on the cross-section S of the magnetic circuit, since the plate 10, which forms part of the magnetic circuit, must have the same cross-section. Assuming that the section is square and has a side a, it is equal $a^2$ and if the length of plate 10 is 3a, its mass is:

$$m=3a^3d(d \text{ meaning the density}).$$

In short:

$$v(T)=(B_s^2/9\mu_o ad)T$$

and $$e(T)=(B_s^2/9\mu_o ad)(T^2/4)$$

This assumes that the induction B is equal to $B_s$ when t=T. The result is that $U/NS=B_s/T$. Consequently:

$$U/N=SB_s/T=a^2B_s/T$$

By way of example we shall examine the speed and displacement which can be obtained with:

$$B_s=1.5 \text{ Tesla},\ a=4\times10^{-3} \text{ m},\ d=8\times10^3 \text{ Kg/m}^3$$

$$v(T)=6200\ T \text{ and } e(T)=1550\ T^2$$

i.e. for $$T=0.2\times10^{-3} \text{ s},$$

$$v=1.25 \text{ m/s and } e=60\ \mu\text{m}.$$

Although the speed reached in this theoretical example is sufficient, the displacement is not. To obtain the required 400 μm under these conditions, an additional time of 0.27 ms is needed, giving a total time of 0.47 ms.

Theoretically also we have a relation $$U/N=0.12 \text{ volts}$$

which does not allow for the leakage flux. The leakage flux is of the same order as the main flux, so that if the number of ampere-turns is equal, the resulting flux is double that which produces the force. The inductance is therefore twice as high, so that the U/N ratio to be taken into consideration is 0.24 volts.

Since plate 10 is mounted for pivoting and consequently its inertia of rotation is only 0.6–0.7 g and the electromagnetic force is exerted only on one air gap (FIG. 2), thus dividing the force by two, we arrive at the desired dimensions.

The current consumed is I=(U/L) T. The order of magnitude of the induction is:

$$L=N^2/\text{reluctance}$$

where reluctance$=g/Su_o=g/a^2u$, and g corresponds to the air gap, i.e. 0.5 mm, and the reluctance, allowing for the leakage flux is:

$$\text{Reluctance}=1.25\times10^7.$$

Finally we obtain:

N=100→L=0,8 mH, U=24 volts, I=6 A

N=500→L=20 mH, U=120 volts, I=1.2 A

The return movement of the actuating needle 1, after impact with the selection latch 2, must be brought about by a negative force. This is provided by electromagnet 12, which is given the same dimensions as electromagnet 11, since the return motion of plate 10 must be identical with the forward motion, provided that the speed after impact is 0 and an abutment cancels the speed during the return.

The graphs in FIGS. 3*a*–3*b*, which all have the same time scale along the abscissa, respectively represent the voltage pulses U, the current pulses I, the speed v and the displacement e in the case of a complete cycle with electromagnets 11 and 12 each having N=100 turns. Note the motion of the actuating needle 1, which theoretically reaches 400 μm in 0.4 ms. At the instant $t_1$, the impact results in an instantaneous loss of speed by the needle. At instant $t_2$ an abutment stops the forward travel. On returning, plate 10 entrains the actuating needle 1. A rear abutment stops the return motion, and the complete cycle lasts 0.5 μs.

The device illustrated in FIG. 2 was constructed in order to check the aforementioned theoretical exposition in practice.

The device was constructed on the principle of a needle-printer head, comprising a tungsten wire 0.35 mm in diameter resiliently held against plate 10 and guided in the sapphire bearing 8.

The supply circuit supplies a 140 volt pulse for 0.12 ms to the winding of electromagnet 11 which controls the advance of the actuating needle 1 (inductance 5.5 mH at 1 kHz, resistance 12 ohms). The peak current is 3.2 A.

When needle 1 is returned, the supply circuit supplies electromagnet 12 (inductance 0.4 mH at 1 kHz, resistance 0.5 ohms) with a 40-volt pulse for 0.12 ms, the pulse building up 0.4 ms after the electromagnet 11 begins to be actuated. The peak current is 11 A.

The behaviour of the device was stroboscopically observed and the displacements were measured on a micrometer scale associated with the observation microscope. The duration of the displacements was measured by supply current pulses from the stroboscope LED, observed on an oscilloscope. By adjusting the position of the supply pulse from the LED relative to the control of the actuating needle 1, it is then possible to draw the graph in FIG. 5, where the motion of needle 1 is shown by the continuous curve and the motion of the latch is shown by the broken-line curve. Elements A and B represent the control pulses. As can be seen, the speed of needle 1 at the moment of impact is of the order of 1.5 m/s, whereas the speed of the latch immediately after impact is of the order of 1 m/s, thus exceeding the previously-calculated necessary speed, which was 0.6 m/s.

Note that these tests were made under laboratory conditions on a single selection latch 2, always acting on the same butt of the latch, which was returned by a spring acting on the other butt, thus slowing down the butt compared with actual conditions, which are therefore more advantageous. However, we chose a spring having very low stiffness, so as to reduce perturbation to a minimum. The repetition frequency of actuation can thus remain sufficiently high to reproduce operating conditions near those actually occurring.

Figure 4:
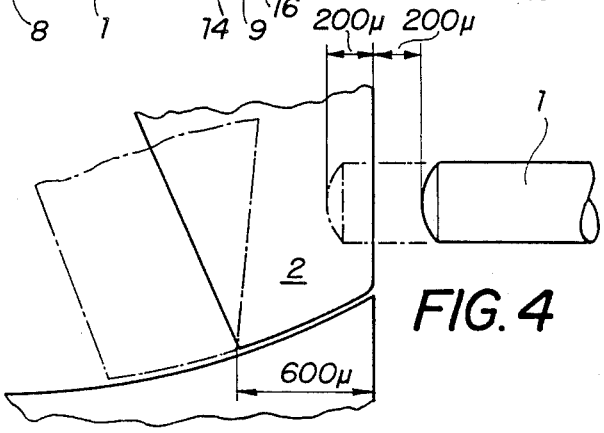
FIG. 4 is a diagram illustrating the relative and positions of the actuating means and the actuated means.

FIG. 4 illustrates the relative positions of needle 1 and latch 2 in their two respective end positions before and after the impact. At rest, latch 2 is 0.2 mm from the end of needle 1. After the impact, the needle continues to move for 0.4 mm from its point of rest, and the latch pivots into recess 6, reaching an amplitude of 0.6 mm.

Other tests were made with a view to obtaining the magnetic flux more quickly, more particularly the flux produced by the electromagnet 11 for moving the needle 1 forward. This requires a high U/SN ratio and a high voltage. In the present case the voltage U is 75 V, the section S is 24 $mm^2$ and the number of turns is 200.

The peak current is 4 A, the pulse duration is 100 us and the speed is ~2.4 m/s. These values have been entered in the groups in FIGS. 3 and 5 in chain-dotted lines, to distinguish them from the theoretical value. As can be seen, there is a marked improvement in performance. Since the more rapidly the flux varies the more eddy-current losses it produces, it is necessary to use a magnetic material having high resistivity such as oriented-grain ferrosilicon, and to make the magnetic circuit out of the aforementioned material in the form of laminated sheets. The solution adopted for the fixed cores of eletromagnets 11 and 12 is that called the "cut magnetic circuit C" as sold under the mark Trafoperm® by Vacuum Schmelze. Plate 10 is also made of sheet metal which is laminated at least on the flat, and also preferably on the edge. This is because the plate is doubly exposed to heat, in that it undergoes variations in flux twice, during the forward and return movement. FIG. 8 shows an embodiment of the plate, comprising a sheet 10*b* bent into a U and containing a stack of flat plates 10*b*. To reduce the weight of the plate, the length of plates 10*b* can be limited to the length of the air gap of electromagnet 11 and 12, in which case the U section 10*a* will be the only portion of plate 10 which emerges from the air gap and to which the needle is secured.

An important feature of the invention is the very high concentration of force on needle 1. In the previously-described example, if the surface area of plate 10 in the air gap is 24 $mm^2$, the needle, which is 0.3 mm in diameter, will have an area of only 0.1 $mm^2$, giving a ratio of 240, all the energy being concentrated on the area of 0.1 $mm^2$.

In order to reduce heating of plate 10, the voltage of coil 12 can be reduced to 50 V, thus reducing the peak current to 2 A. Allowing for the performances obtained, the device can reach 2000 Hz. Since it is undesirable for mechanical reasons to exceed ~1100 Hz at present, the return speed of needle 1 can be reduced.

Long-term impact tests (10 consecutive hours) have not shown any wear on needle 1 or butt 2*b* of latch 2. In any case, the force impulse is limited by a certain buckling of needle 1.

We claim:

1. A method of actuating needle selection latches in a knitting machine, said latches being movable between two end positions, comprising the steps of:

applying an elastic impact to a surface of a latch to be selected thereby moving said latch from a said end position into engagement with a cam, and effecting relative movement of said cam and latch thereby moving said latch into the other said end positions.

2. In a knitting machine comprising a plurality of knitting needles, a plurality of selection latches for selecting said needles respectively, each said latch being mounted for movement between first and second end positions, a selection means adapted to select individual latches, a cam, and means for effecting relative movement of said cam and said latches transversely to a plane in which said latches move, said selection means being arranged and adapted to move a selected latch from said first end position to an intermediate position in engagement with said cam, said relative movement of said cam and the selected latch effecting further movement of said latch into its said second end position;

the improvement wherein the selection means comprises a striker movable towards and away from the latch to be selected, and striker drive means operative to advance the striker towards and into contact with the latch such as to apply an elastic impact to said latch for moving it to said intermediate position, and to retract said striker.

3. The knitting machine of claim 2 characterised in that the striker comprises a longitudinally guided filiform needle, the rear end of which is connected to the free end of a moving armature pivoted at its other end and associated with two electromagnets adapted alternately to exert opposing respective forces on the moving armature and forming the said striker drive means.

4. The knitting machine of claim 3 in which the ratio of the area of the moving armature between the two electromagnets to the cross-sectional area of the needle is more than 200:1.

5. The knitting machine according to claim 3, characterised in that the magnetic circuit of each electromagnet and the moving armature are made of laminated material.

6. The knitting machine according to claim 3, characterised in that the filiform needle is substantially perpendicular to a needle bed bearing the knitting needles.

7. The knitting machine according to claim 3, characterised in that a return spring is associated with the filiform needle and constantly tends to press it against the moving armature.

8. A method of actuating the needle selection latches of a knitting machine, the latches being adapted to occupy two end positions, the transition from the first to the second end position being in made in two stages, a first stage consisting in bringing a component of the latch into engagement with the cam and a second stage resulting from the displacement of the cam relative to the latch transversely to the plane in which the latch oscillates, characterised in that in order to bring the latch component into engagement with the cam, the latch is moved by transmitting motion via an elastic impact to one of its surfaces which forms a lever arm with its pivot point.

9. A method according to claim 8, characterised in that the aforementioned impact is such that said surface of the latch is given a minimum speed of 0.6 m/s.

10. A method according to claim 8, characterised in that the elastic impact is brought about by a striking means which is given an acceleration of more than 2500 $m/s^2$.

11. A method according to claim 10, characterised in that after the impact and the separation of the striking means from the latch, the penetration of the striking means is limited to less than 0.3 mm past the initial position of the struck surface of the latch.

12. A method according to claim 8, characterised in that the elastic impact is brought about by driving a striking means in both the forward and the return direction.

13. A method according to claim 8, characterised in that after the impact, the movement of the latch surface subjected to the impact is of the order of 0.6 mm.

14. A method according to claim 8, characterised in that impacts are brought about on successive knitting-machine needle latches at the same selection level and at a frequency of the order of 1000 HZ.

* * * * *